US009976790B2

(12) United States Patent
Pinto et al.

(10) Patent No.: US 9,976,790 B2
(45) Date of Patent: May 22, 2018

(54) COOLING ELEMENT AND COOLING DEVICE

(75) Inventors: Admilson Pinto, Aach (DE); Andreas Hoffmann, Ammeldingen (DE); Uwe Schramer, Irrel (DE)

(73) Assignee: B Medical Systems S.a.r.l., Hosingen (LU)

( * ) Notice: Subject to any disclaimer, the term of this patent is extended or adjusted under 35 U.S.C. 154(b) by 908 days.

(21) Appl. No.: 14/366,647

(22) PCT Filed: Sep. 10, 2012

(86) PCT No.: PCT/EP2012/067606
§ 371 (c)(1),
(2), (4) Date: Jun. 18, 2014

(87) PCT Pub. No.: WO2013/091913
PCT Pub. Date: Jun. 27, 2013

(65) Prior Publication Data

US 2014/0338390 A1 Nov. 20, 2014

(30) Foreign Application Priority Data

Dec. 20, 2011 (DE) ..... 10 2011 121 552

(51) Int. Cl.
*F25D 11/02* (2006.01)
*F25D 3/08* (2006.01)
(Continued)

(52) U.S. Cl.
CPC ..... *F25D 11/003* (2013.01); *F25B 1/005* (2013.01); *F25D 11/006* (2013.01); *F28F 27/02* (2013.01); *F25D 2303/0822* (2013.01)

(58) Field of Classification Search
CPC ..... F25D 11/003; F25D 11/006; F25D 2303/0822; F28F 27/02; F25B 1/005
(Continued)

(56) References Cited

U.S. PATENT DOCUMENTS 4,637,222 A * 1/1987 Fujiwara ..... B60N 3/103 62/244
4,748,823 A 6/1988 Asano et al.
(Continued)

FOREIGN PATENT DOCUMENTS

CN 2814277 9/2006
CN 1869558 11/2006
(Continued)

*Primary Examiner* — Keith Raymond
*Assistant Examiner* — Steve Tanenbaum
(74) *Attorney, Agent, or Firm* — Jerold I. Schneider; Schneider Rothman Intellectual Property Law Group, PLLC

(57) ABSTRACT

The invention relates to a cooling element (1) for use in a cooling device (11), comprising a front face and a rear face and four side faces. The cooling element (1) is characterized in that the rear face of the cooling element (1) is substantially planar and the front face has reinforcing elements, wherein the reinforcing elements prevent deformation of the cooling element (1) during cooling and freezing. The invention also relates to a cooling device (11), in particular a freezer, comprising at least one cooling circuit, wherein the cooling circuit has a compressor, an evaporator, and a condenser. The cooling device (11) also has a closable cooling space (15) that comprises a plurality of cooling space side walls, a cooling space base, a space for cooling goods (17), and at least one cooling element (1) according to the invention. The cooling device (11) is characterized in that the evaporator and the cooling element (1) are arranged within the cooling space (15), such that the rear face of the cooling element (1) rests against the evaporator and the front face is facing the space for cooling goods (17).

16 Claims, 6 Drawing Sheets

Figure 1:
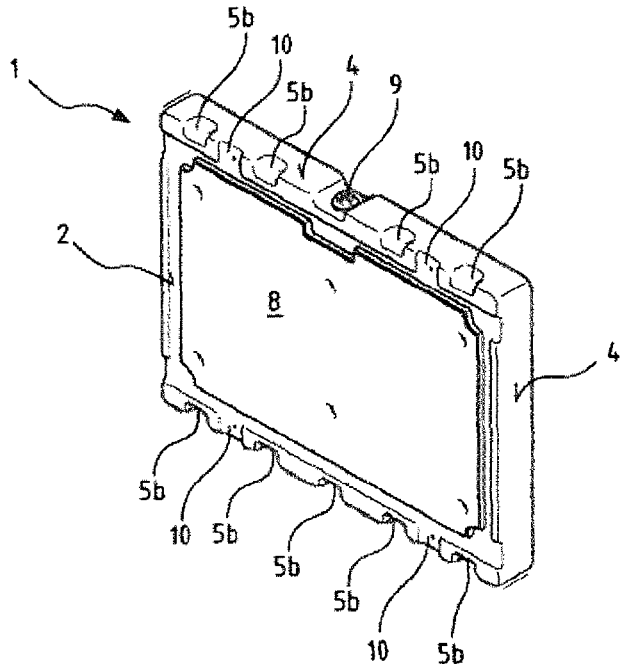

(51) Int. Cl.
*F25D 11/00* (2006.01)
*F25B 1/00* (2006.01)
*F28F 27/02* (2006.01)

(58) Field of Classification Search
USPC ..... 62/441, 457.2
See application file for complete search history.

(56) References Cited

U.S. PATENT DOCUMENTS

| | | | | |
|---|---|---|---|---|
| 7,621,148 | B1 * | 11/2009 | Dain | F25D 23/063 220/592.01 |
| 2007/0193298 | A1 * | 8/2007 | Derifield | B65D 81/3827 62/372 |
| 2007/0289976 | A1 * | 12/2007 | Meyer | F25D 11/003 220/592.09 |
| 2011/0049164 | A1 * | 3/2011 | Banks | B65D 19/02 220/592.01 |
| 2011/0094726 | A1 * | 4/2011 | Jeong | F25D 11/022 165/287 |

FOREIGN PATENT DOCUMENTS

| | | | |
|---|---|---|---|
| CN | 101441014 | | 5/2009 |
| DE | 2726954 | A1 | 1/1979 |
| DE | 102008042907 | | 4/2010 |
| EP | 1302410 | A1 | 4/2003 |
| GB | 2282661 | A | 4/1995 |
| GB | 2465376 | A | 5/2010 |
| JP | 2006008231 | | 1/2006 |
| WO | WO9324797 | | 12/1993 |
| WO | 2005/090881 | A1 | 9/2005 |
| WO | 2010/055295 | A1 | 5/2010 |

* cited by examiner

COOLING ELEMENT AND COOLING DEVICE

The present invention relates to a cooling element for use in a cooling device having a front face, a rear face, and four side faces. Further, the present invention relates to a cooling device having at least one cooling circuit with a compressor, an evaporator, and a condenser as well as a closable cooling space with a plurality of cooling space sidewalls, a cooling space base, and a space for cooling goods.

As a rule, such cooling elements and devices are employed in remote areas in developing countries where a stable and safe energy supply cannot be ensured. Nevertheless, just in these areas an uninterrupted cold chain for food and medical products, such as for example vaccines or blood conserves, is indispensable. In particular, handling the latter products is often difficult, what is considered to be one of the causes for the extremely poor living conditions of the people living there and significantly contributes to the high mortality rate.

Therefore, the World Health Organization (WHO) has made a catalogue with threshold criteria which has to be fulfilled by the used cooling equipment for the transport and storage of medical products. Thus, for the transport for short routes thus in particular insulation boxes with latent-heat storage tanks, ice bags, or so-called freeze packs have established. For the storage of medical products more stringent requirements arise. So, the cooling space temperature must not be higher than +8° C. and not less than +2° C. Further, even upon failure of the power supply sufficient cooling for at least 3 days must be ensured. Thus, in particular electrical cooling apparatuses with and without cooling elements, or battery-driven cooling elements are possible. Here, it has been found to be feasible to generate the power required for operation in a photovoltaic manner since the solar insulation in most developing countries is sufficiently high throughout the year. However, often extra batteries must be used in order that a sufficient amount of medical products can be stored over a prolonged period of time. However, batteries have the disadvantage that the equipment thus has a very high price and the professional disposal of waste batteries has partially proved difficult.

Therefore, an acute need for action arises to prevent the above described drawbacks as far as possible. In the cooling devices known from the prior art several cooling elements are deep-frozen in a separate compartment of a cooling device in a just photovoltaic manner. The thus stored cold then is introduced via a fan into the actual cooling space wherein the medical products are stored. Here, at solar insulation, if present, the compressor permanently runs to maintain a sufficient refrigerating capacity. To prevent that here the cooling space temperature is falling below the minimum required +2° C. and thus the medical products storing in the cooling device are damaged, such cooling devices have a heating that provides thermal energy as needed.

This system has proved to be extremely practicable in longstanding field experiments. However, in this system a sufficient thermal mass for storing the cold must be provided what correspondingly limits the storage capacity for the medical products. Moreover, a number of components is required, such as for example the heating device and the fan, the supply of spare parts and maintenance of which sometimes can involve problems.

Thus, it is the problem of the present invention to provide a cooling element for use in a cooling device and a cooling device in which the above-mentioned criteria of the WHO can be fulfilled, wherein a sufficient storage capacity of the cooling device with renunciation of an additional heating can be provided.

The solution of the problem is accomplished with a cooling element according to claim 1 as well as a cooling device according to claim 8. Practical developments are described in the dependent claims.

The cooling element according to the invention in contrast to the cooling elements known from the prior art is characterized in that the rear face of the cooling element is substantially planar and the front face has reinforcing elements, wherein the reinforcing elements prevent deformation of the cooling element during cooling and freezing. This has the advantage that the cooling elements depending on the cooling agent used do not expand or contract during cooling and freezing by the accompanying expansion or shrinkage, respectively. Thus, an optimum cold input into the cooling element can be achieved at any time, since the rear face of the cooling element intended for transmission keeps its shape and thus extensively and permanently fits to a plate-like evaporator, for example. Moreover, in this way also a complete and homogeneous freezing of the cooling elements is achieved.

Preferably, the reinforcing elements have connecting elements. The connecting elements connect the front face of the cooling element with the rear face of the cooling element. That is, these bridge-like connections extend through the cooling element and help to maintain the shape of the cooling element during the cooling operation.

It is advantageous if the cooling element also has reinforcing elements in the surrounding periphery between the front face and the side faces, wherein the reinforcing elements protrude into the front face and into the side faces. Therefore, these reinforcing elements represent an additional connection between the front face and at least one side face. Thus, also here there is an additional reinforcement that contributes to the maintenance of the shape of the cooling elements during the cooling operation.

Further, it has proved to be suitable if the cooling element on the front face has a recess, wherein the plate-like insulation element can be inserted into the recess. The advantage of the insulation element is that in cooling heat is faster delivered from the cooling element to the evaporator than it is supplied from the cooling space. This permits faster freezing of the cooling element without the temperature of the cooling space falling under the proposed minimum temperature. Further, the insulation element prevents for example that a product to be cooled can come into direct contact with the cooling element. Since water can adhere to the product to be cooled freezing thereto can thus effectively be prevented. Further, in this way it can also be prevented that the temperature in the adjacent cooling space becomes too low and thus the cooling goods storing therein is damaged. Moreover, the reaction rate of the temperature in the space for cooling goods is advantageously reduced and a desired slow-ness is achieved.

It is of advantage if the plate-like insulation element is made of a foamed plastic. Advantageously, the insulation element is directly foamed into the recess with a plastic insulation means, so that the insulation element forms a unit with the cooling element. As the foamed plastic in particular polyurethane, expanded polystyrene, or expanded polypropylene can be used. Alternatively, the plate-like insulation element can also be a vacuum element. This has the advantage that an optimum insulation is achieved.

Preferably, the cooling element has a valve or opening for filling and discharging the cooling element at one side face.

Thus, the cooling element can be filled with cooling agent only when needed at the place of employment, so that in particular in transport advantages by the low weight result.

It is of advantage if the cooling element can be filled with a cooling liquid. It is particularly advantageous if water is used as the cooling liquid. Generally, water is also available in remote areas in developing countries what makes a factory filling of the cooling elements un-necessary. Furthermore, water has relatively good cold storage properties and is not toxic.

Moreover, the invention relates to a cooling device, in particular a freezer. Here, by a freezer a cooling apparatus with a lid is understood, wherein the good to be cooled is inserted into the cooling device or space for cooling goods, respectively, from above. The cooling device according to the invention in contrast to the freezers known from the prior art is characterized in that the evaporator and the cooling element are arranged within the cooling space such that the rear face of the cooling element fits to the evaporator and the front face is facing the space for cooling goods. In other words, the cooling element is not arranged in a separate compartment of the cooling device, but directly within the cooling space, wherein the front face of the cooling element faces the space for cooling goods in which the good to be cooled is located, so for example the medical products. On the one hand, this is advantageous in that a further component for cold transport can be omitted. On the other hand, by arranging the cooling element directly at the evaporator an optimum cold input into the cooling element results, so that a homogeneous freezing of the cooling element is achieved. Here, it is of advantage if the evaporator is designed plate-like and the cooling element with its entire rear face fits to the evaporator.

Preferably, the evaporator at least partially extends over all cooling space sidewalls and one cooling element is assigned to each cooling space sidewall. Thus, an optimum cooling capacity can be achieved by using several cooling elements.

Advantageously, the cooling elements are arranged spaced apart, wherein between the cooling elements insulation means are arranged. That is, in a quadrangular cooling space columnar insulation means are provided in all four corners extending at least over the length of the corresponding side edge of the cooling elements. As the insulation means in particular rigid foam parts made of polyurethane, expanded polystyrene, or expanded polypropylene can be used. This is advantageous in that no direct contact between the evaporator and the space for cooling goods is present, so that no cold bridges in the form of cold air can be formed.

Preferably, the cooling device has at least one partition wall, wherein the partition wall separates the space for cooling goods from the at least one cooling element. Thus, in a four-walled construction of the cooling space with four cooling elements in particular an inner container consisting of four partition walls is possible. Preferably, the partition wall and the inner container, respectively, are made of metal, in particular aluminum or an aluminum alloy. The partition wall or the inner container result in a further separation between the space for cooling goods and the evaporator by which the temperature in the space for cooling goods can be controlled particularly well.

It is particularly preferred, if the cooling device has a connection for an external power source, in particular for a photovoltaic power source. This connection can also be used for connecting another power source, for example for connecting a diesel generator. It is of advantage, if the connection is provided with a safety device against unintentional loosening for example by inattentiveness.

Preferably, the cooling device has a second cooling space and a second evaporator assigned to the second cooling space, wherein the second evaporator is connected to the cooling circuit via a valve. As the valve, for example a three-way solenoid valve can be employed. Thus, the cooling performance can be switched back and forth between the two cooling spaces. This is advantageous in that when in a cooling space the prescribed temperature has already been achieved, the available energy can be used to cool the second cooling space. The second cooling space can have a storage tank, wherein the storage tank can be used to cool the space for cooling goods. Alternatively, the second cooling space can be a freezing compartment in which cooling elements, for example for the transport of the medical products for short routes are frozen.

Furthermore, the cooling device according to the invention can have a second cooling circuit, wherein the second cooling circuit cools an extra cooling space. On the one hand, this is advantageous in that the cooling system is redundant and on the other hand the second cooling circuit can be optimized according to the type of the extra cooling space. Thus, the extra cooling space can have a storage tank, wherein the storage tank can be used to cool the space for cooling goods, or the extra cooling space may also be a freezing compartment. Thus, the second cooling circuit can optimally be adapted to the needs.

Figure 2:
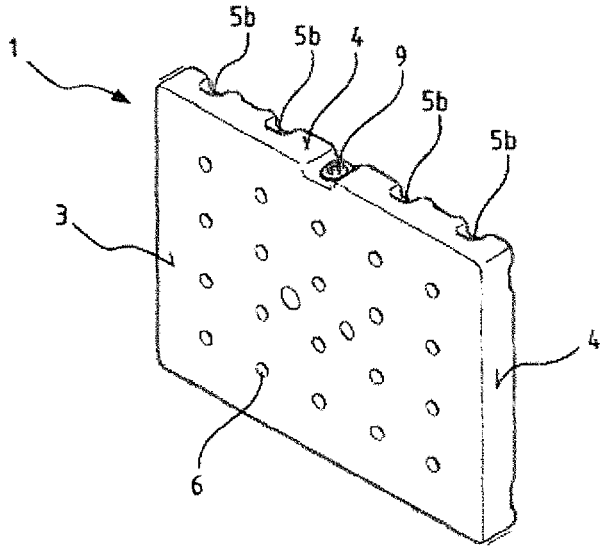
Figure 3:
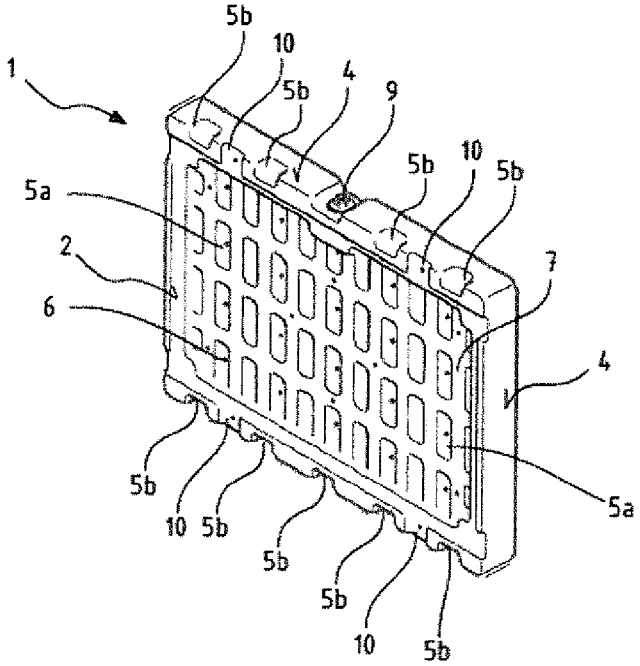
Figure 4:
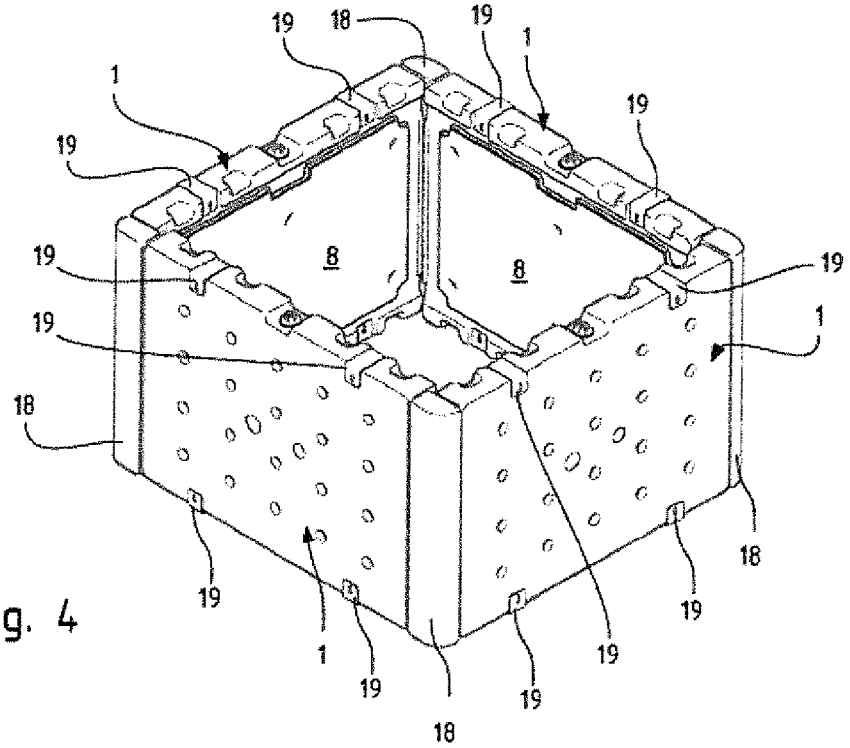
Figure 5:
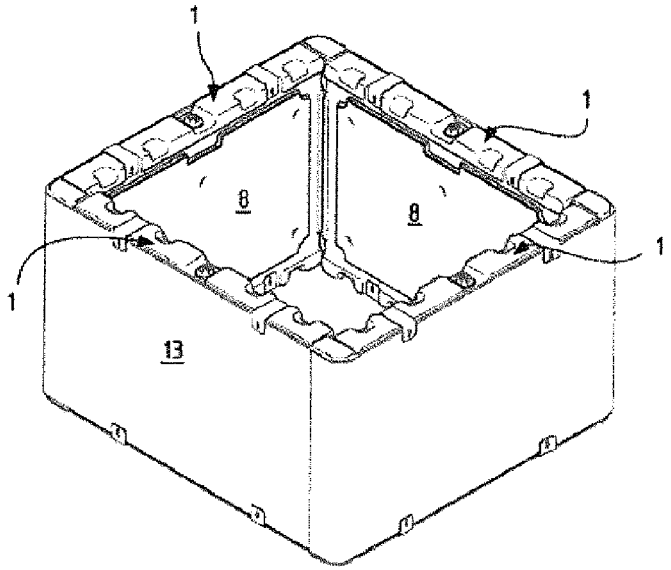
Figure 6:
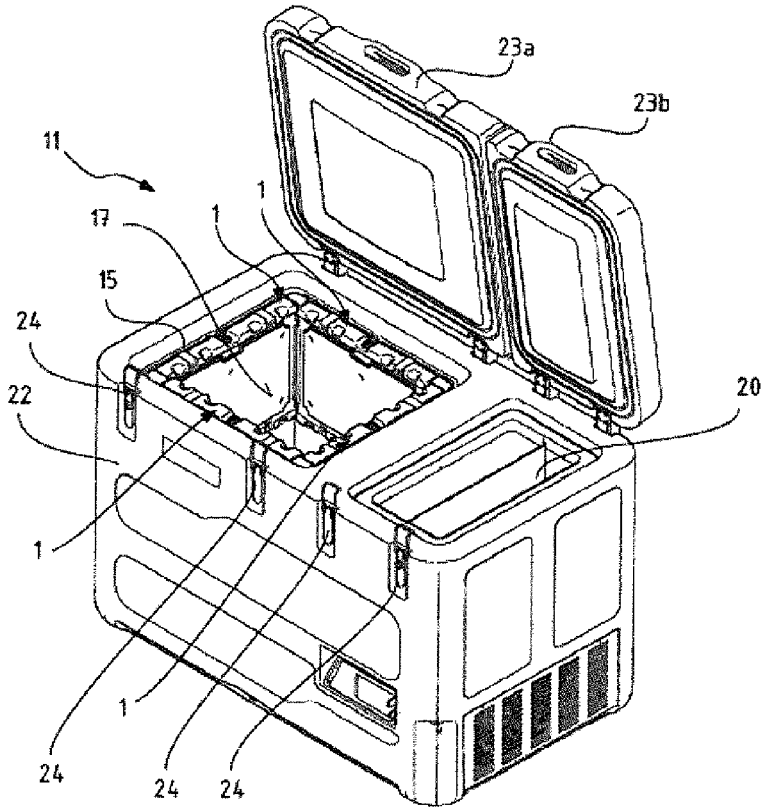
Figure 7:
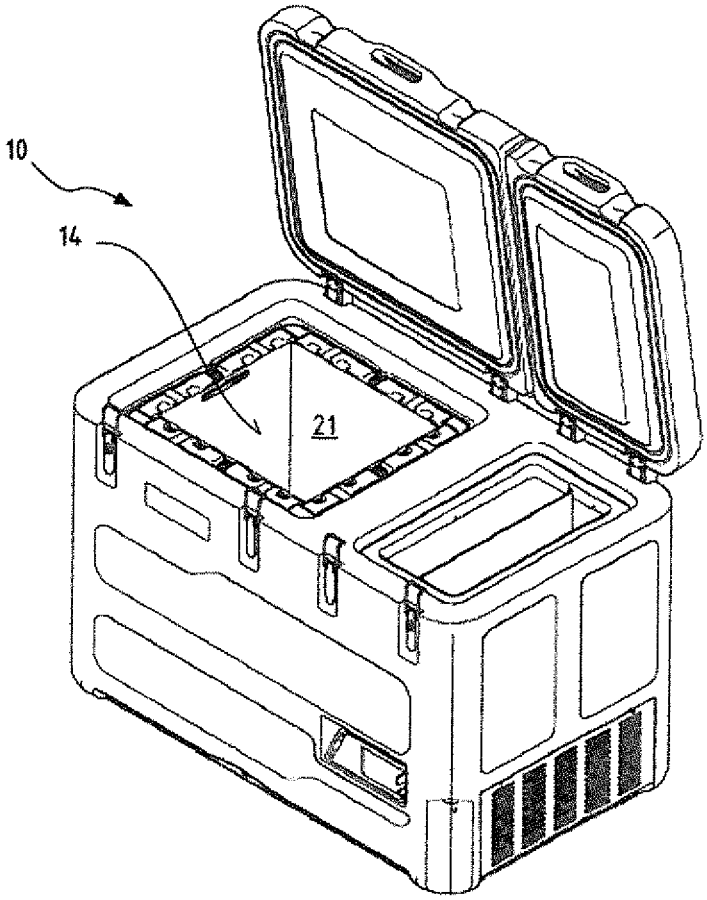
Figure 8:
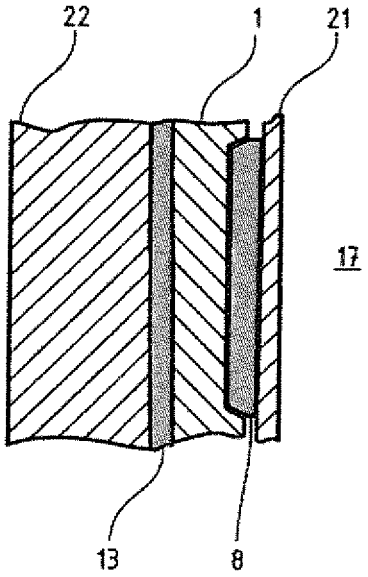
Figure 9:
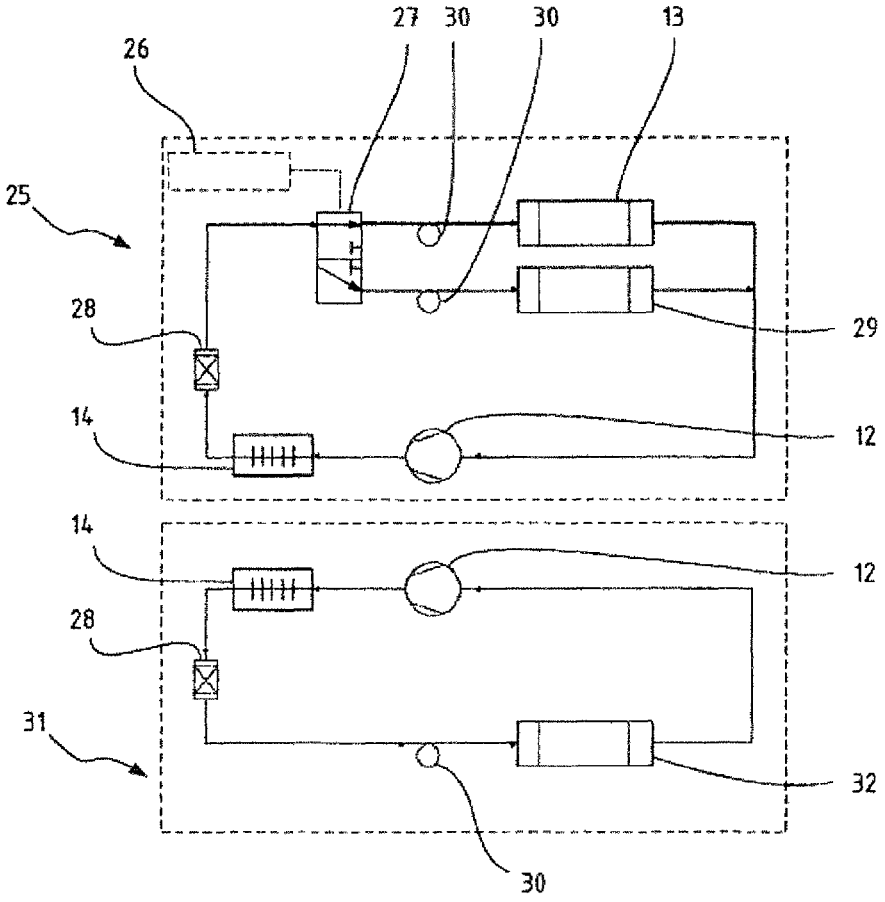

In the following, the invention is explained in detail by way of an example represented in the drawings. Here:

FIG. 1 schematically shows a perspective frontal view of a cooling element according to the invention with an insulation element inserted;

FIG. 2 schematically shows a perspective rear view of a cooling element according to the invention;

FIG. 3 schematically shows a perspective frontal view of a cooling element according to the invention without insulation element;

FIG. 4 schematically shows a perspective view of four cooling elements according to the invention with an intermediate insulation means;

FIG. 5 schematically shows the cooling elements shown in FIG. 4 with an evaporator;

FIG. 6 schematically shows a cooling device according to the invention with inserted cooling elements without partition wall;

FIG. 7 schematically shows the cooling device shown in FIG. 6 with partition wall;

FIG. 8 schematically shows a principle sectional view of the construction of the cooling device; and FIG. 9 schematically shows a schematic representation of the cooling system.

In FIGS. 1 to 3 a cooling element 1 having a front face 2, a rear face 3, and four side faces 4 is shown. The cooling element on its front face 2 has a plurality of reinforcing elements 5*a* that at least partially are connected to the rear face 3 of the cooling element 1 via connecting elements 6. The reinforcing elements 5*a* are arranged in a projecting manner in a recess 7 on the front face 2 and have a quadrangular shape with rounded edges. Further, the cooling element has nine reinforcing elements 5*b* in the surrounding periphery between the front face 2 and the two longer side faces 4. The reinforcing elements are designed as recesses and protrude both into the respective side faces 4 and the front face 2. In FIG. 1, the cooling element 1 according to the invention is shown with a plate-like insulation element 8 of polyurethane that is inserted into the recess 7.

Further the cooling element 1 according to the invention has a valve 9 with which the cooling element 1 can be filled with cooling means or discharged, respectively. For example, valve 9 may be realized as a screw or bolt cap.

As in particular represented in FIGS. 1 and 3, the cooling element 1 has a plurality of mounting areas 10 for mounting the cooling element in the cooling space 15 of the cooling device 11 (cf. FIG. 4 and FIG. 6) as well as mounting the evaporator 13 (cf. FIG. 5). In this example, the cooling element 1 has four mounting areas 10 at which mounting lugs 19 can be mounted (see, FIGS. 4 and 5).

The cooling element 1 represented in FIGS. 1 to 3 is made of polyethylene and is prepared by rotation molding. However, it is also conceivable that other materials and/or methods can be applied for the preparation.

FIG. 4 shows four cooling elements 1 according to the invention, as represented in FIGS. 1 to 3, that are rectangular arranged with intermediate insulation means 18. The cooling elements 1 are arranged spaced apart such that no direct contact between the cooling elements 1 is generated, wherein in each of the four corner areas one insulation means 18 is arranged that keeps the cooling elements 1 in a distance. Insulation means 18 are columnar and in particular made of polyurethane. Each insulation means 18 has two side faces and one rounded outer face. In this example, the side faces of the insulation means 18 are not identical, wherein the actual size or geometry, respectively, results from the geometry of the cooling space 15 of the cooling device 11 (see, FIGS. 6 and 7).

The cooling elements 1 are arranged such that the front faces 3 with insulation elements 8 face each other. For securing the position the insulation means 18 may for example be mounted to the respective adjacent cooling elements 1 with an easily detachable adhesive.

Further, in FIG. 4 mounting lugs 19 are illustrated with these extending in a U-shape from the front face 2 to the rear face 3 of the cooling element. As is shown, the mounting lugs 19 at each end have an opening for a mounting means, such as for example a screw or a pin. In this example, in total four mounting lugs 19 are used per cooling element 1, wherein also more or less mounting lugs 19 can be used.

FIG. 5 shows the arrangement of the cooling element 1, as represented in FIG. 4, wherein here also the evaporator 13 is shown. The evaporator 13 comprises four interconnected plates each of which fits flat to the planar rear face 3 of each cooling element 1. The evaporator 13 is mounted by the mounting lugs 19 to the cooling elements 1 and the cooling elements 1 are mounted by the mounting lugs 19 to the evaporator 13, respectively. From FIG. 5 it is also well seen that due to the arrangement of the cooling elements 1 in interaction with the insulation means 18 no direct contact between the space for cooling goods 17 (see FIG. 6) and the evaporator 13 is generated, so that no cold bridges can establish.

In FIG. 6 a cooling device according to the invention is shown in the form of a freezer 11 having two closable cooling spaces 15, 20. The cooling spaces 15, 20 can be closed with lids 23*a*, 23*b*. The lids 23*a*, 23*b* are mounted to the freezer body 22 by means of a hinge and can be mounted via locking means 24. These locking means 24 may be lockable, so that protection against theft can be ensured.

In the example shown in FIG. 6 the arrangement of four cooling elements 1 shown in FIG. 5 is already mounted in the first cooling space 15. As can also be well seen in FIG. 5, the cooling elements 1 and the evaporator 13, respectively, do not extend over the entire depth of the cooling space 15. Accordingly, this results in a space for cooling goods 17 partially defined by the cooling elements 1 and partially by the cooling space sidewalls.

The second space for cooling goods 20 (the right one in the illustration) in this example is a freezing compartment in which (not shown in detail) ice bags or freeze packs can be frozen. Said ice bags or freeze packs can be removed when the cooling good has to be transported over limited routes for example to a patient, so that the cold chain is not interrupted.

The freezer 11 shown in FIG. 7 corresponds to the freezer 11 as illustrated in FIG. 6, wherein in FIG. 7 additionally the partition walls 21 for the individual cooling elements 1 are shown. Here, the partition walls 21 are in the form of an inner container 21 fitting to the insulation elements 8 of the cooling elements 1. The inner container 21 is for the better control and adjustment, respectively, of the temperature of the space for cooling goods. Not shown, but to be mentioned in this context is a temperature sensor detecting the temperature of the space for cooling goods. Preferably, this sensor is arranged at the bottom of the first cooling space 15.

The schematic construction of the freezer 11 consisting of freezer body 22, evaporator 13, cooling element 1, insulation element 8, and partition wall 21 is shown for better clarity in FIG. 8 as a principle sketch. Here, the evaporator 13 is guarded against the space for cooling goods 17.

FIG. 9 shows the schematic construction of a first (at the top) cooling circuit 25 and an optional second cooling circuit 31 (at the bottom). Seen in the flow direction of the refrigerant, the first cooling circuit 25 consists of a compressor 12, a condenser 14, and a drier 28. In particular, the drier 28 can be realized as a filter drier. The drier 28 is followed by a three-way valve 27 that is connected to a controller 26. In this example, a three-way solenoid valve is used. The three-way valve 27 is switched by the controller such that either a first evaporator 13 or a second evaporator 29 is selected. For example, the first evaporator 13 may be the above described evaporator 13 in the cooling space 15 for cooling the cooling good, whereas the second evaporator 29 is assigned to the freezing compartment or second cooling space 20, respectively, illustrated on the right side in FIGS. 5 and 6, for example. Alternatively, the second evaporator 29 may also be assigned to a storage tank (not shown) that is used for cooling the space for cooling goods 17, for example in case of an insufficient solar insulation. Upstream of the evaporators 13, 29 there is still provided a throttle 30 for expansion of the refrigerant. Here, the controller 26 is programmed such that the second evaporator 29 is only selected when a sufficiently low temperature has been achieved in the space for cooling goods 17, namely a temperature in range between +2° C. and +8° C.

The optional second cooling circuit 31 shown below in FIG. 9 substantially corresponds to the first cooling circuit 25, wherein the valve and the respective controller were omitted. Thus, the second cooling circuit 31 consists of a compressor 12, a condenser 14, a drier 28, a throttle 30, and an evaporator 32. For example, the second cooling circuit 31 can cool an above described storage tank or can be used for cooling the freezing compartment or the second cooling space 20, respectively.

LIST OF REFERENCE NUMBERS

1 Cooling element
2 Front face
3 Rear face
4 Side face
5*a, b* Reinforcing element
6 Connecting element

7 Recess
8 Insulation element
9 Valve
10 Attachment area
11 Freezer/Cooling device
12 Compressor
13 Evaporator
14 Condenser
15 Cooling space
16 Cooling space sidewall
17 Space for cooling goods
18 Insulation means
19 Mounting lug
20 Second cooling space
21 Partition wall/Inner container
22 Freezer body
23*a, b* Freezer lid
24 Locking means
25 Cooling circuit
26 Controller
27 Three-way valve
28 Drier
29 Second evaporator
30 Throttle
31 Second cooling circuit
32 Evaporator (second cooling circuit)

What is claimed is:

1. A cooling device comprising at least one cooling circuit, wherein the cooling circuit has a compressor, an evaporator, and a condenser, a closable cooling space with a plurality of cooling space sidewalls, a cooling space base, and a space for cooling goods, and at least one cooling element, wherein the cooling element comprises a front face and a rear face, wherein the evaporator and the cooling element are arranged in the cooling space such that the rear face of the cooling element fits to the evaporator and the front face is facing the space for cooling goods, wherein the rear face of the cooling element is substantially planar, wherein the front face has reinforcing elements, wherein the reinforcing elements prevent deformation of the cooling element during cooling and freezing and wherein the reinforcing elements comprise connecting elements which connect the front face of the cooling element and the rear face of the cooling element.

2. The cooling device of claim 1, wherein the evaporator extends at least partially over all cooling space sidewalls and one cooling element is assigned to each cooling space sidewall.

3. The cooling device of 2, wherein the cooling elements are arranged spaced apart, wherein insulation means are arranged between the cooling elements.

4. The cooling device of claim 3, wherein the cooling device has at least one partition wall, wherein the partition wall separates the space for cooling goods from the at least one cooling element.

5. The cooling device of claim 4, wherein the cooling device has a connection for a photovoltaic power source.

6. The cooling device of claim 5, wherein the cooling device has a controller, and wherein the controller keeps the temperature of the space for cooling goods in a range between 2° C. and 8° C.

7. The cooling device of claim 1, wherein the cooling element comprises reinforcing elements in a surrounding periphery between the front face of the cooling element and side faces of the cooling element and wherein said reinforcing elements protrude into the front face and into the side faces.

8. The cooling device of claim 1, wherein a plate-like insulation element is arranged between the front face of the cooling element and the cooling space.

9. The cooling device of claim 1, wherein the cooling element has a recess on its front face and wherein a plate-like insulation element is inserted into the recess.

10. The cooling device of claim 9, wherein the plate-like insulation element is selected from a foamed plastic insulation element and a vacuum insulation element.

11. The cooling device of claim 1, wherein the cooling element comprises a valve at one side face for filling the cooling element with a cooling liquid.

12. The cooling device of claim 11, wherein the cooling element is filled with water.

13. A cooling device comprising at least one cooling circuit, wherein the cooling circuit has a compressor, an evaporator, and a condenser, a closable cooling space with a plurality of cooling space sidewalls, a cooling space base, and a space for cooling goods, at least one cooling element, wherein the cooling element comprises a front face, a rear face and four side faces, and a controller, and wherein the controller keeps the temperature of the space for cooling goods in a range between 2° C. and 8° C., wherein the evaporator and the cooling element are arranged in the cooling space such that the rear face of the cooling element fits to the evaporator and the front face is facing the space for cooling goods, wherein the rear face of the cooling element is substantially planar, wherein the front face has reinforcing elements, wherein the reinforcing elements prevent deformation of the cooling element during cooling and freezing and wherein the reinforcing elements comprise connecting elements which connect the front face of the cooling element and the rear face of the cooling element, wherein the cooling element has a recess on its front face and wherein a plate-like insulation element is inserted into the recess, and wherein said plate-like insulation element is selected from a foamed plastic insulation element and a vacuum insulation element.

14. The cooling device of claim 13, wherein the cooling element comprises reinforcing elements in a surrounding periphery between the front face of the cooling element and side faces of the cooling element and wherein said reinforcing elements protrude into the front face and into the side faces.

15. The cooling device of claim 13, wherein the cooling element comprises a valve at one side face for filling the cooling element with a cooling liquid.

16. The cooling device of claim 15, wherein the cooling element is filled with water.

* * * * *